United States Patent [19]

Morishita et al.

[11] Patent Number: 4,987,786

[45] Date of Patent: Jan. 29, 1991

[54] COAXIAL ENGINE STARTER WITH SPACED OUTPUT SHAFT BEARINGS

[75] Inventors: Akira Morishita; Shuzoo Isozumi, both of Himeji, Japan

[73] Assignee: Mitsubishi Denki Kabushiki Kaisha, Tokyo, Japan

[21] Appl. No.: 430,540

[22] Filed: Nov. 2, 1989

[30] Foreign Application Priority Data

Nov. 2, 1988 [JP] Japan ..... 63-277750
Nov. 2, 1988 [JP] Japan ..... 63-277751

[51] Int. Cl.[5] ..... F02N 15/06

[52] U.S. Cl. ..... 74/7 C; 74/7 A; 74/7 E

[58] Field of Search ..... 74/6, 7 R, 7 A, 7 E, 74/7 C; 290/38 R, 38 C, 48

[56] References Cited

U.S. PATENT DOCUMENTS

| | | | |
|---|---|---|---|
| 2,333,765 | 11/1943 | Celio | 74/7 A X |
| 4,613,761 | 9/1986 | Yabunaka | 290/36 R |
| 4,760,274 | 7/1988 | Isozumi | 74/7 E X |
| 4,800,766 | 1/1989 | Isozumi et al. | 74/7 E |
| 4,852,417 | 8/1989 | Tanaka | 74/7 A X |
| 4,907,464 | 3/1990 | Isozumi | 74/7 E X |

FOREIGN PATENT DOCUMENTS

| | | |
|---|---|---|
| 1311876 | 11/1962 | France . |
| 63-71474 | 5/1988 | Japan . |

OTHER PUBLICATIONS

U.S. National Phase of PCT Application Serial No. 221,245.

*Primary Examiner*—Allan D. Herrmann
*Attorney, Agent, or Firm*—Sughrue, Mion, Zinn, Macpeak and Seas

[57] ABSTRACT

An output rotary shaft 12 of a coaxial engine starter has at one end thereof a pinion 19 engageable with an engine ring gear and is inserted at the other end into a tubular armature rotary shaft 11*a* of a motor. A clutch inner member 15*b* of a unidirectional clutch having helical splines formed in its inner circumference is engaged with a helical spline portion 12*a* formed on the armature rotary shaft. The engine starter further comprises a bearing surface 21*a;* 26 on the clutch inner member and a bearing 13 fitted within the inner circumferential surface of the tublar armature rotary shaft, and the output rotary shaft is supported by the bearing surface of the clutch inner member and the bearing. The output rotary shaft may have an enlarged-diameter portion 12*b* at the position inserted within the armature rotary shaft, which axially extends substantially between the helical spline portion and the bearing and defines a small annular clearance 24 between it and the inner circumferential surface of the armature rotary shaft.

4 Claims, 3 Drawing Sheets

COAXIAL ENGINE STARTER WITH SPACED OUTPUT SHAFT BEARINGS

BACKGROUND OF THE INVENTION

This invention relates to a coaxial engine starter and more particularly to a coaxial engine starter for a vehicular internal combustion engine.

FIG. 1 illustrates one example of a conventional coaxial engine starter disclosed for example in Japanese Utility Model Laid-Open No. 63-71474. As shown in FIG. 1, the conventional coaxial engine starter 1 comprises a d.c. electric motor 2 having a hollow armature rotary shaft 3 having an inner passage 3*a* formed therein. A plunger rod of an electromagnetic switch (not shown) disposed at the rear end of the d.c. electric motor 2 is inserted into the inner passage 3*a* of the armature rotary shaft 3 so that the front end of the plunger is engageable with the rear end of the output rotary shaft 4 coaxially inserted into the inner passage 3*a* of the armature rotary shaft 3 from its front end to push forward the output rotary shaft 4.

It is seen from FIG. 1 that the output rotary shaft 4 is provided at its front end (the right end as viewed in FIG. 1) with a pinion gear 5 for engaging and driving an engine ring gear (not shown). The rear end 4*a* (the left end as viewed in FIG. 1) of the output rotary shaft 4 which is inserted into the inner passage 3*a* of the armature rotary shaft 3 is journaled by a sleeve bearing 6 fitted in the inner circumference of the inner passage 3*a* so that the output rotary shaft 4 is slidable in the axial direction. The rotational driving force from the armature rotary shaft 3 of the d.c. electric motor 2 is transmitted to the axially slidable output rotary shaft 4 by a drive force transmission mechanism 8 including an over-running clutch or a unidirectional clutch 7 and a planetary speed reduction gear 9.

The unidirectional clutch 7 comprises an annular clutch outer member 7*a*, a clutch inner member 7*b* disposed inside of the clutch outer member 7*a* and a plurality of rollers 7*c* disposed between the clutch outer and inner members 7*a* and 7*b*. The clutch inner member 7*b* has formed in an inner circumferential surface helical splines which are in engagement with a helical spline portion 4*c* on the outer circumference of an enlarged-diameter flange portion 4*b* of the output rotary shaft 4. The planetary speed reduction gear 9 comprises a sun gear 9*a* integrally formed around the outer circumference of the front end of the armature rotary shaft 3 and planetary gears 9*b* supported around the sun gear 9*a* by pivot pins 9*c* attached to the clutch outer member 7*a* of the unidirectional clutch 7.

In the conventional coaxial engine starter 1 of the above construction, when the output rotary shaft 4 slides forward to cause the pinion thereon to engage with an engine ring gear (not shown), the reactive force generated on the output rotary shaft 4 upon the engagement is supported by the helical spline portion 4*c* and the sleeve bearing 6. Therefore, the maximum bending moment on the output rotary shaft 4 is exerted on the enlarged-diameter flange portion 4*b* on which the helical spline portion 4*c* is formed, so that the stress on a step portion P or a rear end face of the flange portion 4*b* can become significantly large to such an extent that the step portion P is broken or damaged.

SUMMARY OF THE INVENTION

Accordingly, one object of the present invention is to provide a coaxial engine starter which is free from the above discussed problem of the conventional coaxial engine starter.

Another object of the present invention is to provide a coaxial engine starter in which the rear end face of the flange-shaped helical spline portion is not broken or damaged.

Still another object of the present invention is to provide a coaxial engine starter in which the breaking of the output rotary shaft at the position where the maximum bending moment is applied is prevented.

With the above object in view, the coaxial engine starter of the present invention comprises an electric motor having a tubular armature rotary shaft defining therein an inner passage and an axially slidable output rotary shaft disposed at the front end of the electric motor and having at one end thereof a pinion engagable with a ring gear of an engine and inserted at the other end into the inner passage of the armature rotary shaft. A unidirectional clutch, including a clutch inner member having helical splines formed in its inner circumference, is disposed for transmitting a rotation of the armature rotary shaft to the output rotary shaft, and a helical spline portion is formed in an outer circumference of the armature rotary shaft so that it is in engagement with the helical splines of the clutch inner member of the unidirectional clutch. The coaxial engine starter further comprises a bearing surface defined on an inner circumference of the clutch inner member for rotatably and slidably supporting the output rotary shaft, and a bearing fitted within the inner circumferential surface of the inner passage of the tubular armature rotary shaft of the electric motor for rotatably and slidably supporting the output rotary shaft. An enlarged-diameter portion may be provided on the output rotary shaft at the position inserted within the inner passage of the armature rotary shaft, the enlarged-diameter portion axially extending substantially between the helical spline portion and the bearing and defining a small annular clearance between the enlarged-diameter portion and the inner circumferencial surface of the armature rotary shaft.

According to the coaxial engine starter of the present invention, a bearing surface defined on an inner circumference of the clutch inner member for rotatably and slidably supporting the output rotary shaft at a front portion thereof and a bearing fitted within the inner circumferential surface of the inner passage of the tubular armature rotary shaft of the electric motor for rotatably and slidably supporting the output rotary shaft are provided. Therefore, the reaction force exerted to the output rotary shaft upon the engagement of the pinion on the output rotary shaft and the engine ring gear is supported at two separated positions, so that the maximum bending moment on the output rotary shaft is generated at the portion where the output rotary shaft contacts with the inner cylindrical circumferential surface of the cylindrical member integrally forwardly extending from the clutch inner member, whereby the bending moment on the helical spline portion or the flange step portion is significantly reduced as compared to that of the conventional design, resulting in the reduced stress acting upon the step portion of the rear end face of the helical spline portion.

According to another embodiment of the coaxial engine starter of the present invention, the enlarged-diameter portion is provided on the output rotary shaft at the position inserted within the inner passage of the armature rotary shaft, and this enlarged-diameter portion axially extends substantially between the helical spline portion and the bearing and defines a small annular clearance between the enlarged-diameter portion and the inner circumferencial surface of the armature rotary shaft. Therefore, the stress generated on the output rotary shaft upon the engagement of the pinion on the output rotary shaft and the engine ring gear can be effectively accommodated by this enlarged-diameter portion, whereby the breaking or damage of the output rotary shaft at the position where the maximum bending moment is avoided.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
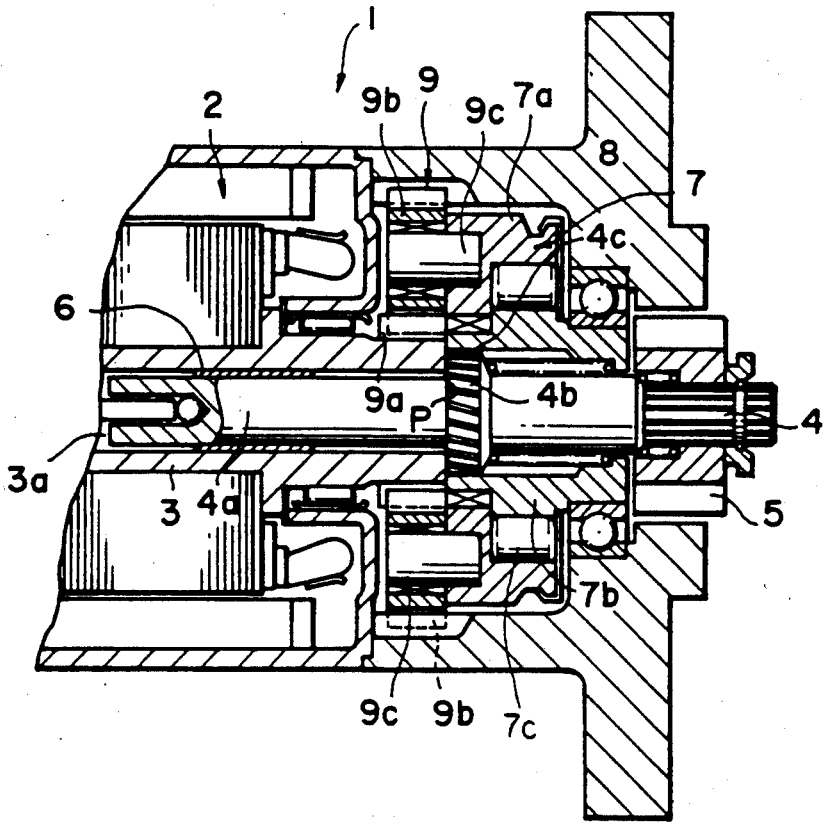
FIG. 1 PRIOR ART
FIG. 1 is a fragmental sectional side view of the conventional coaxial engine starter.
Figure 2:
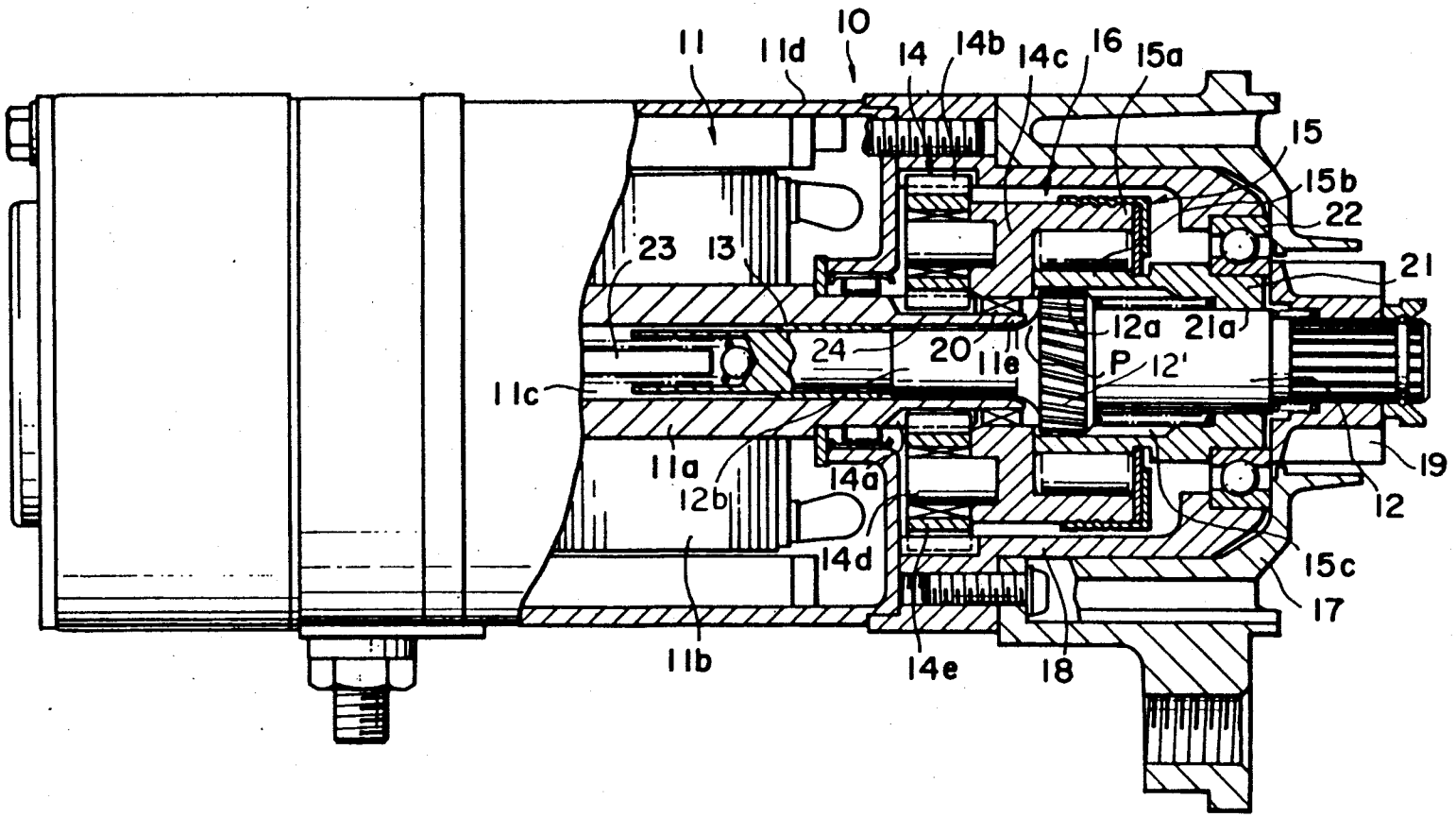
FIG. 2 is a sectional side view illustrating one embodiment of the coaxial engine starter of the present invention.

FIG. 2 illustrates one embodiment of the coaxial engine starter 10 of the present invention, which comprises a d.c. electric motor 11 having a yoke **11*d* which also serves as a motor frame and a tubular armature rotary shaft 11*a* mounted along the central axis of the yoke 11*d*. The tubular armature rotary shaft 11*a* has securely mounted thereon an armature core 11*b*. An output rotary shaft 12 is disposed on the front side (right side as viewed in FIG. 2) of the d.c. motor 11 in an axially aligned relationship with respect to the armature rotary shaft 11*a*. The output rotary shaft 12 is inserted at its rear (left side as viewed in FIG. 2) end portion into an inner passage 11*c* of the tubular armature rotary shaft 11*a* and is rotatably and axially slidably supported by a sleeve bearing 13 securely fitted to the inner circumference portion of the armature rotary shaft 11*a* at an axial position corresponding to that of the yoke 11*d***.

The rotational force of the armature rotary shaft **11*a* is transmitted to the output rotary shaft 12 through a driving force transmission mechanism 16 comprising a planetary speed reduction gear 14 and a unidirectional clutch 15. The planetary speed reduction gear 14 comprises a sun gear 14*a* integrally formed on the outer circumference of the front end of the armature rotary shaft 11*a*, an internal gear 14*b* formed in the inner surface of a bracket 18 disposed between the yoke 11*d* and a front bracket 17 constituting a part of the machine frame of the engine starter 10, and a plurality of planetary gears 14*e* meshing with the sun gear 14*a* and the internal gear 14*b* and rotatably supported by pins 14*d* secured to a carrier 14*c* integral with a clutch outer member 15*a* of the unidirectional clutch 15. The clutch inner member 15*b* of the unidirectional clutch 15 has helical splines 15*c* in its inner circumferential surface, which are in engagement with a helical spline portion 12*a* integrally formed on an enlarged-diameter flange-shaped portion 12 of the output rotary shaft 12. Therefore, the output rotary shaft 12 is permitted to axially slide relative to the clutch inner member 15*b* while it is driven by the clutch inner member 15*b*. On the front end of the output rotary shaft 12 projecting outward from the front bracket 17, a pinion gear 19** for driving an unillustrated engine ring gear is mounted.

The carrier **14*c* of the planetary speed reduction gear 14 has mounted at its inner circumference a bearing 20 which is mounted to a reduced-diameter portion 11*e* of the front end adjacent to the sun gear 14*a* of the armature rotary shaft 11*a*. Thus, the bearing 20 prevents the radial movement of the carrier 14*c* of the planetary speed reduction gear 14, so that there is no possibility of eccentricity of the carrier 14*c*. Also, the clutch inner member 15*b* of the unidirectional clutch 15 has a cylindrical portion 21 integrally extending from its front end which is rotatably supported by a bearing 22 mounted between the outer circumference of the clutch inner member 15*b* and the inner end of the bracket 18. The cylindrical portion 21 has an inner circumferential surface 21*a* slidably fitted over the outer circumference of the output rotary shaft 12 to serve as a bearing surface 21*a* for supporting the output rotary shaft 12. As previously described, the bearing 13 for supporting the rear portion of the output rotary shaft 12 is positioned in the inner circumferential portion of the armature rotary shaft 11*a* inside of the yoke 11*d* of the d.c. motor. More precisely, the axial position of the bearing 13 is between the armature core 11*b* and the sun gear 14*a*. The reason that the bearing 13 is not at the same axial position as the armature core 11*b* is that bearing 13 can be appropriately mounted to the inner circumference of the tubular armature rotary shaft 11*a* at this axial position where the shaft is not deformed by pressfitting of the armature core 11*b* thereon. It is also to be noted that the output rotary shaft 12 has an enlarged-diameter portion 12*b* having an outer circumferential surface close to the inner circumferential surface of the armature rotary shaft 11*a* between the bearing 13 and the flange-shaped portion or helical spline portion 12*a*. In other words, the enlarged-diameter portion 12*b* of the output rotary shaft 12 axially extends from the rear end of the helical spline portion 12*a* to the position beyond the axial position of the sun gear 14*a* formed on the end portion of the armature rotary shaft 11*a*, and the annular gap between the outer circumferential surface of the enlarged-diameter portion 12*b* and the inner circumferential surface of the armature rotary shaft 11*a* is a narrow clearance 24**.

On the other hand, although not illustrated, a solenoid switch is mounted on the rear (left side as viewed in FIG. 2) and of the d.c. motor 11. The solenoid switch (not shown) is actuated when the ignition switch of the vehicle is turned on, whereby a rod 23 is moved by the electromagnetic movement of the plunger (not shown) to push forward the output rotary shaft 12 so that the pinion 19 on the output rotary shaft 12 engages with the engine ring gear (not shown) and, at the same time, d.c. motor 11 for rotating the pinion 19 is energized.

The operation of the coaxial engine starter will now be briefly described.

When the starter switch of the vehicle is turned on, the excitation coil of the solenoid switch is energized to electromagnetically move the rod 23 in the forward direction (to the right as viewed in FIG. 2). This causes the output rotary shaft 12 to be pushed by the rod 23 so that the pinion gear 19 mounted on the front end of the output rotary shaft 12 is brought into engagement with the engine ring gear (not shown). At the same time, when the plunger (not shown) of the solenoid switch is electromagnetically driven, movable and stationary contacts are closed to energize and rotate the d.c. motor 11. The rotation of the armature rotary shaft 11*a* of the d.c. motor 11 is speed-reduced by the planetary speed reduction gear 14 and is transmitted to the clutch outer member 15*a* of the unidirectional clutch 15, and the rotation of the clutch outer member 15*a* is transmitted to the clutch inner member 15*b* through cylindrical rollers. The rotation of the clutch inner member 15*b* is transmitted to the output rotary shaft 12 through the helical splines 12*a* and 15*c* to drive and start the engine by the pinion gear 19. After the engine has been started, the unidirectional clutch 15 prevents the reverse driving of the starter.

According to the coaxial engine starter 10 of the present invention, the rear portion of the output rotary shaft 12 is supported by the bearings 13 mounted to the inner circumferential surface of the tubular armature rotary shaft 11*a*, and the front portion of the output rotary shaft 12 is supported by the bearing surface 21*a* of the cylindrical portion 21 integrally extending forward from the front end of the clutch inner member 15*b* of the unidirectional clutch 15. Therefore, the reaction force exerted on the output rotary shaft 12 generated upon the engagement of the pinion gear 19 and the engine ring gear (not shown) is supported by the front portion and the rear portion, whereby the maximum bending moment is not applied at the step P of the flange portion of the output rotary shaft 12, eliminating the possibility that the previously discussed stress, which breaks or damages this portion of the output rotary shaft 12, appears.

The bearing surface 21*a* which is the inner circumferential surface of the cylindrical member 21 integral with the clutch inner member 15*b* may be formed by grinding after cementation hardening in order to prevent compression deformation of the bearing surface 21*a*. Also, it is preferable that the rear bearing 13 supporting the rear portion of the output rotary shaft 12 is located as rear as possible because the value of $P \times V$ (P is surface pressure of the bearing and V is the rotational speed) which expresses the durability level decreases. Further, the bearing surface 21*a* of the cylindrical portion of the clutch inner member supporting the front portion of the output shaft 12 preferably has a grease groove therein.

Figure 3:
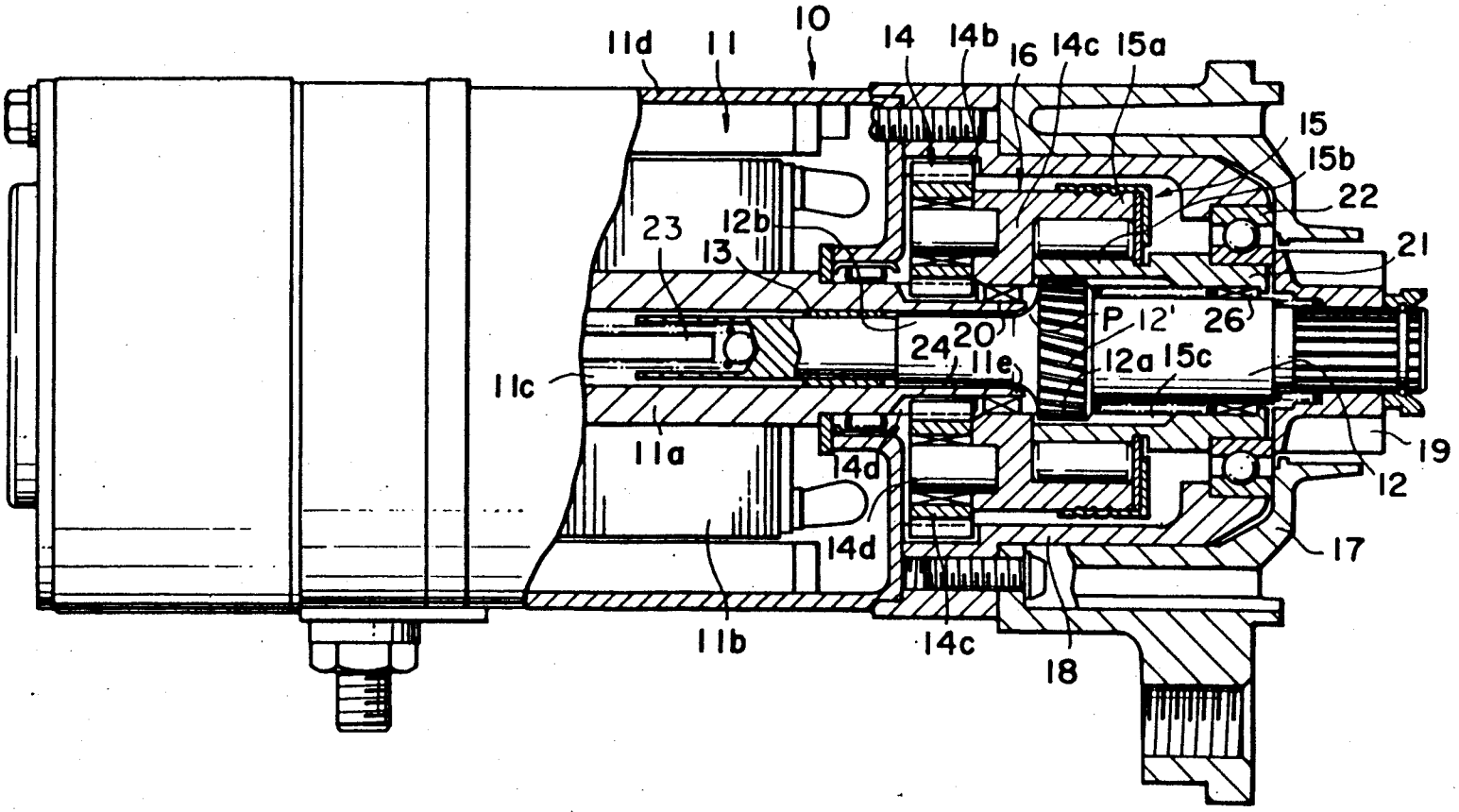
FIG. 3 is a sectional side view illustrating another embodiment of the coaxial engine starter of the present invention.

FIG. 3 illustrates another embodiment of the coaxial engine starter 10 of the present invention, which is the same as the FIG. 2 embodiment except that the rear or sleeve bearing 13 is slightly shorter, and the cylindrical portion or member 21 has an inner circumferential surface which is supported by a bearing 26 slidably fitted over the outer circumference of the output rotary shaft 12 to serve as a bearing surface for supporting the output rotary shaft 12.

According to the coaxial engine starter 10 of the present invention, the output rotary shaft 12 has the enlarged-diameter portion 12*b* extending from the rear end of the helical spline portion 12*a* of the output rotary shaft 12 to the portion supported by the bearing 13 mounted to the inner circumferential surface of the tubular armature rotary shaft 11*a*, so that even when the stress exerted to the output rotary shaft 12 generated upon the engagement of the pinion gear 19 and the engine ring gear (not shown) acts around the position of the maximum bending moment, the stress can be effectively supported by the output rotary shaft 12.

As has been described, according to the first embodiment of the coaxial engine starter of the present invention, the rear portion of the output rotary shaft is supported by a bearing mounted to the inner circumferential surface of the tubular armature rotary shaft and the front portion of the output rotary shaft is supported by a bearing surface. Therefore, the maximum bending moment acting on the output rotary shaft 12 is generated at the position where the outer circumference of the output rotary shaft 12 contacts the inner bearing surface 21*a* of the cylindrical member 21 integrally extending from the clutch inner member 15*b*, and the bending moment and therefore the stress at the step portion of the rear end of the helical spline portion is decreased, whereby the damage or breakage of the output rotary shaft can be prevented.

According to the second embodiment of the coaxial engine starter of the present invention, the enlarged-diameter portion is provided on the output rotary shaft at the position inserted within the inner passage of the armature rotary shaft, and this enlarged-diameter portion axially extends substantially between the helical spline portion and the bearing and defines a small annular clearance between the enlarged-diameter portion and the inner circumferencial surface of the armature rotary shaft. Therefore, the stress generated on the output rotary shaft upon the engagement of the pinion on the output rotary shaft and the engine ring gear can be effectively accommodated by this enlarged-diameter portion, whereby the breaking or damage of the output rotary shaft at the position where the maximum bending moment appears is avoided. Also, since the clearance defined between the enlarged-diameter portion of the output rotary shaft and the front end portion of the armature rotary shaft is very small, the grease filled within the starter does not freely flow therethrough. Also, the ingress of dust, worn particles or the like into the inside of the armature rotary shaft can be prevented.

What is claimed is:

1. A coaxial engine starter, comprising:

an electric motor having a tubular armature rotary shaft (11*a*) defining therein an inner passage (11*c*);

an axially slidable output rotary shaft (12) disposed at a front end of said electric motor and having at one end thereof a pinion (19) adapted to be engaged with a ring gear of an engine and inserted at the other end into said inner passage of said armature rotary shaft;

a unidirectional clutch (15), including a clutch inner member (15*b*) having helical splines (15*c*) formed in an inner circumference thereof, for transmitting a rotation of said armature rotary shaft to said output rotary shaft;

a helical spline portion (12*a*) formed in an outer circumference of said output rotary shaft and in engagement with said helical splines of said clutch inner member of said unidirectional clutch;

a bearing surface defined on an inner circumference of said clutch inner member for rotatably and slidably supporting said output rotary shaft; and a bearing (13) fitted within an inner circumferential surface of said inner passage of said tubular armature rotary shaft of said electric motor for rotatably and slidably supporting said output rotary shaft, wherein said bearing surface is an inner circumferential cylindrical surface (21*a*) of a hollow cylindrical member (21) integrally extending forward from said clutch inner member.

2. A coaxial engine starter as claimed in claim 1, wherein said output rotary shaft has an enlarged-diameter portion (12*b*) at the position inserted within said inner passage of said armature rotary shaft, said enlarged-diameter portion axially extending substantially between said helical spline portion and said bearing and defining a small annular clearance (24) between said enlarged-diameter portion and said inner circumferential surface of said armature rotary shaft.

3. A coaxial engine starter, comprising:

an electric motor having a tubular armature rotary shaft (11*a*) defining therein an inner passage (11*c*);

an axially slidable output rotary shaft (12) disposed at a front end of said electric motor and having at one end thereof a pinion (19) adapted to be engaged with a ring gear of an engine and inserted at the other end into said inner passage of said armature rotary shaft;

a unidirectional clutch (15), including a clutch inner member (15*b*) having helical splines (15*c*) formed in an inner circumference thereof, for transmitting a rotation of said armature rotary shaft to said output rotary shaft;

a helical spline portion (12*a*) formed in an outer circumference of said output rotary shaft and in engagement with said helical splines of said clutch inner member of said unidirectional clutch;

a bearing surface defined on an inner circumference of said clutch inner member for rotatably and slidably supporting said output rotary shaft; and a bearing (13) fitted within an inner circumferential surface of said inner passage of said tubular armature rotary shaft of said electric motor for rotatably and slidably supporting said output rotary shaft, wherein said bearing surface is an inner circumferential surface of a bearing (26) attached to an inner surface of a hollow cylindrical member (21) integrally extending forward from said clutch inner member.

4. A coaxial engine starter s claimed in claim 6, wherein said output rotary shaft has an enlarged-diameter portion (12*b*) at the position inserted within said inner passage of said armature rotary shaft, said enlarged-diameter portion axially extending substantially between said helical spline portion and said bearing and defining a small annular clearance (24) between said enlarged-diameter portion and said inner circumferential surface of said armature rotary shaft.

* * * * *